United States Patent [19]

Miyachi et al.

[11] 4,395,991

[45] Aug. 2, 1983

[54] EMISSION PREVENTING SYSTEM OF EVAPORATED FUEL FOR INTERNAL COMBUSTION ENGINE

[75] Inventors: Sumio Miyachi; Jun Taue, both of Iwata, Japan

[73] Assignee: Yamaha Hatsudoki Kabushiki Kaisha, Iwata, Japan

[21] Appl. No.: 227,661

[22] Filed: Jan. 23, 1981

[51] Int. Cl.[3] ..... F02M 25/08

[52] U.S. Cl. ..... 123/520; 123/519

[58] Field of Search ..... 123/518, 519, 520

[56] References Cited

U.S. PATENT DOCUMENTS

| | | | |
|---|---|---|---|
| 3,554,175 | 1/1971 | Sarto | 123/519 |
| 3,618,578 | 11/1971 | Swatman et al. | 123/519 |
| 3,673,997 | 7/1972 | Sawada | 123/519 |
| 3,675,634 | 7/1972 | Tatsutomi et al. | 123/519 |

FOREIGN PATENT DOCUMENTS

| | | | |
|---|---|---|---|
| 2054043 | 11/1979 | Fed. Rep. of Germany | 123/518 |
| 54-47905 | 2/1979 | Japan | 123/520 |
| 54-141916 | 5/1979 | Japan | 123/519 |
| 55-5420 | 1/1980 | Japan | 123/519 |
| 55-5465 | 1/1980 | Japan | 123/518 |

*Primary Examiner*—Tony M. Argenbright

*Attorney, Agent, or Firm*—Donald D. Mon

[57] ABSTRACT

An internal combustion engine in which a fuel evaporated in a fuel tank is stored in a crankcase, including a system for preventing the evaporated fuel from being emitted into the atmosphere. The crankcase is in communication with an intake passage through a breather passage and with the atmosphere through an atmospheric vent. Change-over means provides communication between the crankcase and the intake passage while the engine is running, and vents the crankcase to the atmosphere when the engine is stopped.

10 Claims, 12 Drawing Figures

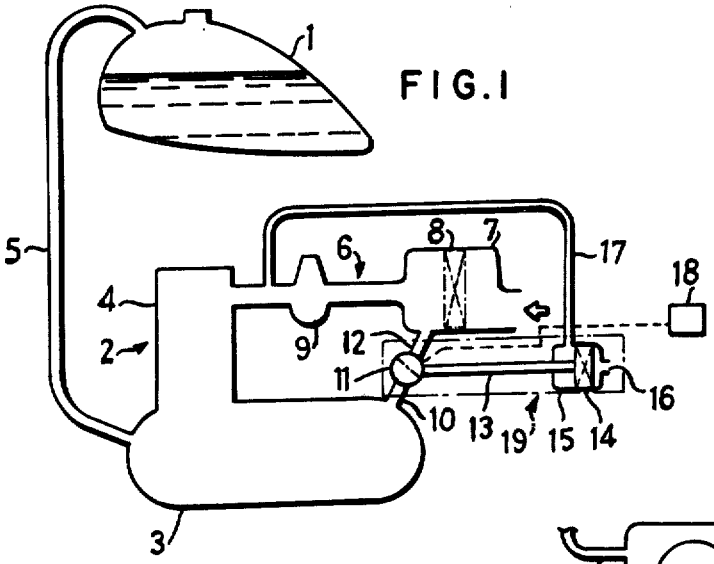
FIG. 1
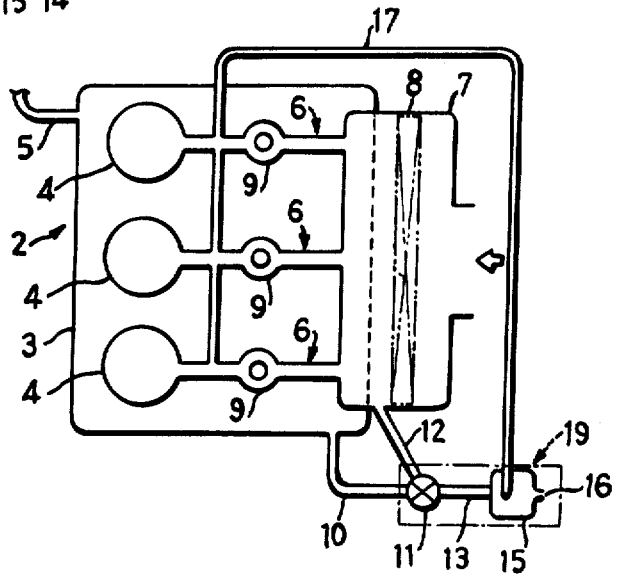
FIG. 2
FIG. 3 (a)
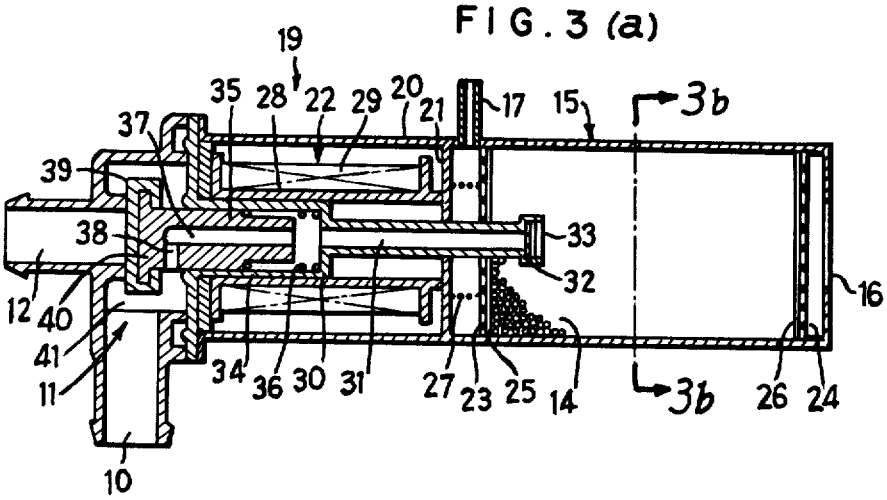
FIG 3 (b)
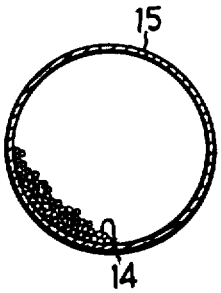

EMISSION PREVENTING SYSTEM OF EVAPORATED FUEL FOR INTERNAL COMBUSTION ENGINE

DETAILED DESCRIPTION OF THE INVENTION

The present invention relates to an emission preventing system for evaporated fuel in an internal combustion engine, and more particularly to a system for preventing evaporated fuel, which is evaporated in a fuel tank, from being emitted into the atmosphere by storing the same in a crankcase.

BACKGROUND OF THE INVENTION

Fuel in a fuel tank is evaporated by influcence from the ambient temperature, and its evaporation rate becomes remarkably high especially when the fuel tank is exposed in summer directly to the rays of the sun. If such evaporated fuel is discharged, as it is, into the atmosphere, it becomes one of the causes of air pollution. It follows that the so-called "crankcase storage system" has been adopted, in which the evaporated fuel is stored in the crankcase having a relatively large capacity to prevent the air pollution.

However, even the crankcase has a limited capacity so that it cannot store evaporated fuel any more when it becomes saturated with the fuel.

Therefore, there has been developed a system which has its storage capacity for evaporated fuel increased by connecting the crankcase and the intake passage of the engine so that the evaporated fuel may be sucked out of the crankcase during running operation of the engine until it is fully consumed. With this construction and arrangement, however, if the crankcase reaches saturation while the engine is stopped, the evaporated fuel coming from the crankcase fills up the intake passage so that it not only contaminates the air cleaner but also is sucked from the intake passage into the combustion chamber by the vacuum established in the combustion chamber as the engine is started, whereby the air-fuel ratio (A/F) may become richer than the normal inflammable mixture ratio thereby making it difficult to start the engine.

BRIEF DESCRIPTION OF THE INVENTION

The present invention has been made in view of the backround thus far described and contemplates providing an emission preventing system for evaporated fuel for an internal combustion engine, in which the evaporated fuel in the crankcase is not introduced into an intake passage but released to the atmosphere, when the engine is stopped, so that any overrich air-fuel ratio may be prevented, when the engine is to be started, thereby to smooth out the starting operation.

BRIEF DESCRIPTION OF THE DRAWINGS

FIG. 1 is a diagrammatic side elevation showing the construction of one embodiment of the invention;

FIG. 2 is a top plan view of the invention;

FIG. 3*a* is a cross-sectional view showing the assembly of a three-way change-over valve and a canister into a unit.

FIG. 3*b* is a sectional view taken along IIIB—IIIB of FIG. 3*a;*

Figure 4:
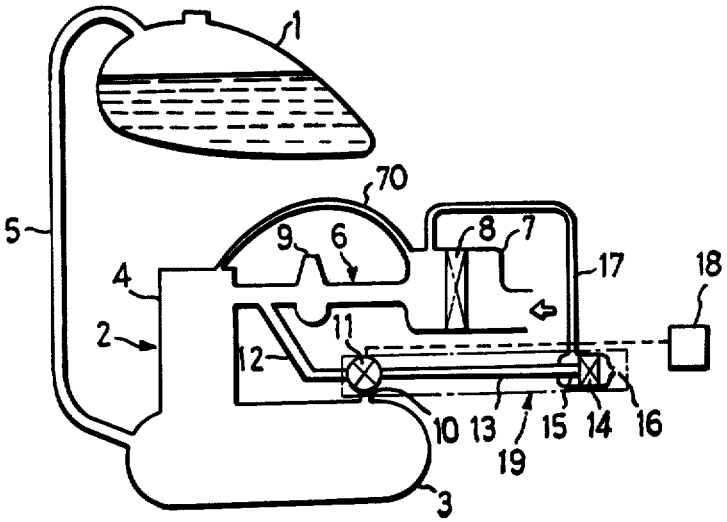
FIG. 4 is a side elevation of another embodiment of the invention.

The present invention will now be described in connection with a first embodiment thereof with reference to the accompanying drawings.

In FIG. 1, reference numeral 1 indicates a fuel tank for an internal combustion engine 2 of the three cylinder type, for example, in which three cylinders 4 are juxtaposed to each other above a crankcase 3. The crankcase 3 is in communication through an overflow passage 5 with upper portion of tank 1 so that the fuel evaporated fuel can be introduced and stored therein. Each cylinder 4 is connected through an intake passage 6 to an air cleaner 7, which operates to suck in ambient air in the direction of arrow thereby to clean the air by means of a cleaner element 8. Each intake passage 6 is equipped with a carburetor 9. Incidentally, the intake passage is defined as the passage leading to cylinder 4 and includes the air cleaner 7.

From the aforementioned crankcase 3, on the other hand, there is an introduction passage 10, which is branched through a three-way change-over valve 11 into a breather passage 12 and a venting passage 13. The aforementioned breather passage 12 is in communication with intake passage 6, in the present invention, downstream of cleaner element 8 of air cleaner 7. On the other hand, venting passage 13 is in communication with a canister 15, charged with activated charcoal 14, and atmospheric vent 16, which opens to canister 15, through the pores in the aforementioned activated carcoal 14. In the present embodiment, on the other hand, the aforementioned three-way change-over valve 11, venting passage 13 and canister 15 are integrated into a unit, as shown in FIG. 3, which will be described hereinafter. Out of the aforementioned canister 15, a purge passage 17 is in communication with intake passages 6 or branched, in the case of the present invention, downstream of the respective carburetors 9 in communication with the respective intake passages 6. On the other hand, the three-way change-over valve 11 communicates with crankcase 3 and venting passage 13, when the engine 2 is stopped, thereby to shut off the breather passage 12. While the engine 2 is running, on the contrary, the three-way change-over valve 11 communicates crankcase 3 with the intake passage 6 through the breather passage 12 thereby to shut off the venting passage 13. For this purpose, three-way change-over valve 11 is constructed of a later-described electromagnetic change-over valve, for example, which is controlled by means of a controller 18. This controller 18 is made operative to detect a stopped or running engine 2 thereby to feed the electromagnetic three-way change-over valve 11 with an electric signal. In this example, the controller 18 detects the stop and start of the engine, and its change-over timing is determined by detecting the start of the engine 2. The aforementioned change-over timing relating to the start may be any instance when the ignition switch is turned, when the starting device such as a kick pedal or a self-starter is operated and when the engine reaches complete combustion. In case the change-over timing is the instant when the ignition switch is turned on, the present invention can be practiced even if the aforementioned controller 18 is the ignition switch itself. On the other hand, in case the change-over timing is the instant when the kick pedal or the self-starter is operated, the present invention can also be practised if the controller is made operative in response to the detection of the voltage generated by a dynamo or the rotational speed of the engine. However, the most desired situation is the case in which the instant when the engine reaches complete combustion is deemed as the engine start. More specifically, when the engine reaches its complete combustion state, the voltage generated by the dynamo or the rotational speed of the engine becomes higher than before complete combustion, and the exhaust pressure, the intake vacuum or the lubricating oil pressure exceeds a predetermined level, different from before the complete combustion. As a result, any of these parameters can be utilized so that the present invention can be practised by the controller 18 made operative in response to any of the parameters detected.

The unit 19, composed of the aforementioned three-way change-over valve 11, venting passage 13 and canister 15, may be constructed, as described with reference to FIGS. 3(*a*) and (*b*). Specifically, a case 20, the inside of which is axially partitioned by a partition 21. One of the compartments thus partitioned forms the canister 15, whereas the other compartment is equipped with an electromagnetic actuating mechanism 22. The canister 15 is charged with the activated charcoal 14, and a porous slide plate 23 and a porous end plate 24 are arranged with the activated charcoal 14 inbetween. The porous slide plate 23 and the porous end plate 24 are covered with filters 25 and 26, respectively, which are made of paper. The aforementioned porous slide plate 23 presses against the activated charcoal 14 by the action of a coil spring 27 which is held under compression between the slide plate 23 and the partition 21. Incidentally, the porous end plate 24 is positioned to face the atmospheric vent 16. On the other hand, the aforementioned purge passage 17 leads out from between the partition 21 and the porous slide plate 23. The electromagnetic actuating mechanism 22 is, a magnetizing coil 29 wound upon a core 28, of a non-magnetic material, so that the coil 29 generates a magnetic field when it is energized by the aforementioned controller 18. Into the aforementioned core 28, there is inserted a sleeve 30 also made of a non-magnetic material. This sleeve 30 is so stepped that one end portion having a smaller diameter is formed with a passage 31 which extends through the aforementioned partition 21 and porous slide plate 23 until it is in communication with activated charcoal 14. Incidentally, the passage 31 is also equipped at its open end with a porous plate 32 and a filter 33. The larger diameter portion of the aforementioned sleeve 30 is formed into a cylinder 34 which receives a plunger 35. This plunger 35 is made of a magnetic material and is unidirectionally urged by the action of a coil spring 36. Moreover, this plunger 35 is also formed therein with a passage 37 which is in communication with the passage 31 of the smaller diameter portion of the aforementioned sleeve 30. The passages 31 and 37 thus formed constitute the aforementioned venting passage 13 shown in FIGS. 1 and 2. The passage 37 in the aforementioned plunger 35 has an opening at 38 in the side of the plunger 35, and the opening 38 is opened and closed by such action as will be described hereinafter. The plunger 35 per se constitutes the aforementioned three-way change-over valve 11. More specifically, the plunger 35 has its other end formed integrally with a valve 40 covered with a cushion member 39 of rubber or the like which is received in a valve chamber 41. This valve chamber 41 leads to the aforementioned introduction passage 10 and is in communication with the breather passage 12. This breather passage 12 has one end axially directed to face the aforementioned valve body so that it is shut off when the valve body 40 is moved in the opposite direction. At this time, the opening 38 formed in the plunger 35 restores communication with the valve chamber 41. When the valve body 40 opens the breather passage 12, on the other hand, the aforementioned opening 38 is inside cylinder 34 so that it is closed.

The operation of the first embodiment thus constructed will be described in the following.

The evaporated fuel in the fuel tank 1 is introduced through the overflow passage 5 into the crankcase 3, where it is stored. Since the controller 18 remains inoperative when engine 2 is stopped (which is preferably before complete combustion, as has been described hereinbefore, but may be before starting or before the ignition switch is turned), the magnetizing coil 29 of FIG. 3 is left deenergized. Since there is no magnetic field generated, therefore, the plunger 35 is urged by the action of the coil spring 36 so that the valve body 40 closes the breather passage 12. Since, in this instance, the opening 38 is in communication with the valve chamber 41, the introduction passage 10 is in communication with the venting passage 13. Moreover, when the evaporated fuel in the crankcase 3 reaches its evaporation limit, it is introduced through the aforementioned introduction passage 10 and venting passage 13 into the canister 15. In this canister 15, the evaporated fuel comes into contact with the activated charcoal 14 so that the air pollutants are absorbed. Thus, the evaporated fuel thus cleaned by the activated charcoal 14 is discharged to the atmosphere through the atmospheric vent 16. As a result, the atmosphere is not polluted. Meanwhile, since the breather passage 12 is closed by the valve body 40, the evaporated fuel saturating the crankcase 3 never flows into the air cleaner 7 in the intake passages 6. As a result, the evaporated fuel does not remain in the intake passages 6 nor contaminates the cleaner element 8.

During running operation of the engine 2, on the contrary, since the controller 18 is operating, the magnetizing coil 29 is energized to generate its magnetic field, by which the plunger 35 is attracted against the action of the coil spring 36. Thus, the valve body 40 partly opens the breather passage 12 and partly closes the opening 38 and accordingly the venting passage 13. As a result, the crankcase 3 is in communication with the air cleaner 7. In accordance with the running operation of the engine, moreover, the intake passages 6 sucks the ambient air through the air cleaner 7 together with the evaporated fuel in the crankcase 3 so that this fuel is mixed with the mixture, which is prepared by the carburetors 9, until it is distributed into the respective combustion chambers 4. As a result, during the running operation of the engine 2, the evaporated fuel in the crankcase 3 is fully consumed. Therefore, even if additional fuel is evaporated in the fuel tank 1 when the engine 2 is stopped again, there is no evaporated fuel left in the crankcase 3. The crankcase 3 can store the evaporated fuel so that it can retain sufficient storage capacity until it is saturated. From the description thus far made, it should be realized that the capacity of the crankcase can be kept small.

During operation of the engine 2 as above, since the canister 15 is in communication with the respective intake passages 6 through the purge passage 17 and since the venting passage 13 is shut off, the intake vacuum established in the intake passages 6 is exerted upon the purge passage 17 thereby establishing an air flow into the intake passages 6 through the atmospheric vent 16, the canister 15 and the purge passage 17. As a result, the ambient air sucked through atmospheric vent 16 comes into contact with the activated charcoal 14 thereby to desorb the aforementioned air pollutants out of the activated charcoal 14. The air pollutants thus desorbed are carried through the purge passage 17 into the intake passages 6 and are burned out in the cylinders 4. In other words, the activated charcoal 14 is cleaned by the air flow to restore its absorptivity for air pollutants from the crankcase 3 for the next engine stop. Thus, the adsorptivity of the activated charcoal 14 is maintained at a high level to extend the lifetime of the canister 15 and reduce its size to minimize space requirements.

Moreover, since the purge passage 17 branches into the respective intake passages 6, the air pollutants carried in the aforementioned air flow, especially, the fuel components are distributed evenly to the respective cylinders 4. As a result, no imbalance in the air-fuel ratio (A/F) among the cylinders 4 arises so that the smooth running operation can be ensured.

According to the embodiment thus far described, since no evaporated fuel in the crankcase 3 is introduced into the intake passages 6 while the engine 2 is stopped, the intake passages cannot be filled up with the evaporated fuel. At the start of the engine 2, since there is a lack of fuel in intake passage 6 the A/F ratio in the cylinders cannot become overrich during low air flow rate. This assures a smooth start and prevents large quantities of contaminates from being mixed with exhaust gases due to low A/F ratio.

In order to prevent the A/F ratio from becoming excessively low at the engine start, as has been described in the above, the communication initiating timing between the crankcase 3 and the intake passages 6, i.e., the change-over timing of the three-way change-over valve 11 is important. In other words, a problem results when the start of the engine 2 is preset for the best result. As has been described hereinbefore, improved results can be attained if the change-over timing occurs at the instant when the ignition switch is turned or or delayed to the instant when the starter is operated. However, the best results are attained if the complete combustion in the engine 2 is used as the boundary. More specifically, when engine 2 reaches its complete combustion state it means that the engine 2 has reached its stable running range after it has been started. When this stable running range is reached, the ratio at which the evaporated fuel will adversely affect the A/F ratio is reduced, and even if the evaporated fuel is introduced from crankcase 3 into the intake passages 6, stable operation of the engine 2 will be maintained even for a slight overrichness, if any.

Figure 5:
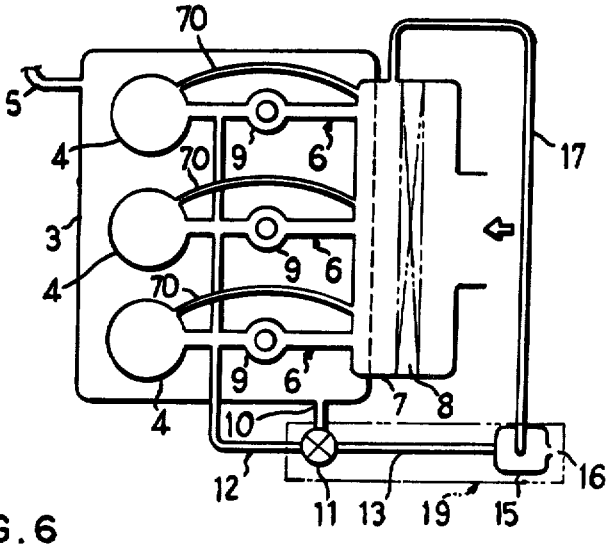
FIG. 5 is a top plan view of the embodiment of FIG. 4.

In the first embodiment thus far described, incidentally, the breather passage 12 is in communication with the air cleaner 7, and the purge passage 17 is in communication with the respective intake passages 6 downstream of the corresponding carburetors 9. However, the present invention need not be limited to such construction but can be embodied in another construction. In a second embodiment shown in FIGS. 4 and 5, similar results can be achieved by a construction in which the breather passage 12 branches out to connect with each intake passage 6 downstream of its respective carburetor 9 and a purge passage 17 is in communication with air cleaner 7 which in turn is connected by bypass passages 70 to each respective cylinder 4.

Figure 6:
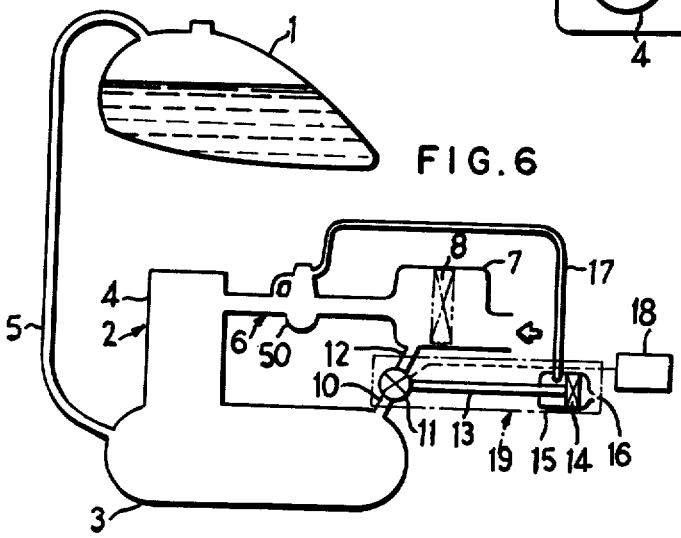
FIG. 6 is a side elevation of a third embodiment of the invention.
Figure 7:
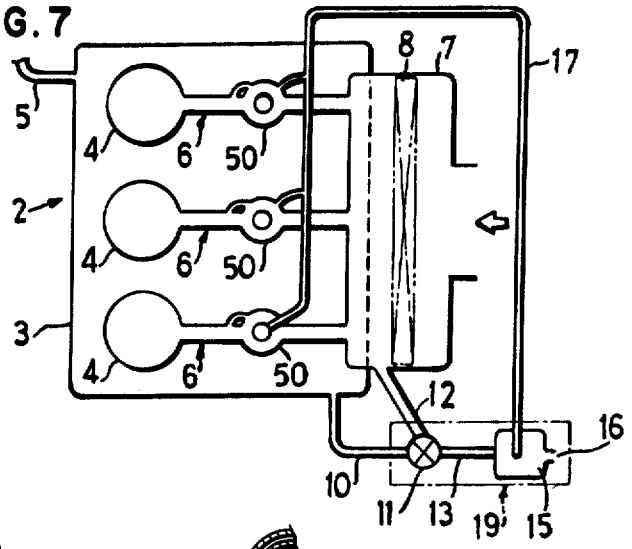
FIG. 7 is a top plan view of the embodiment of FIG. 6.
Figure 8:
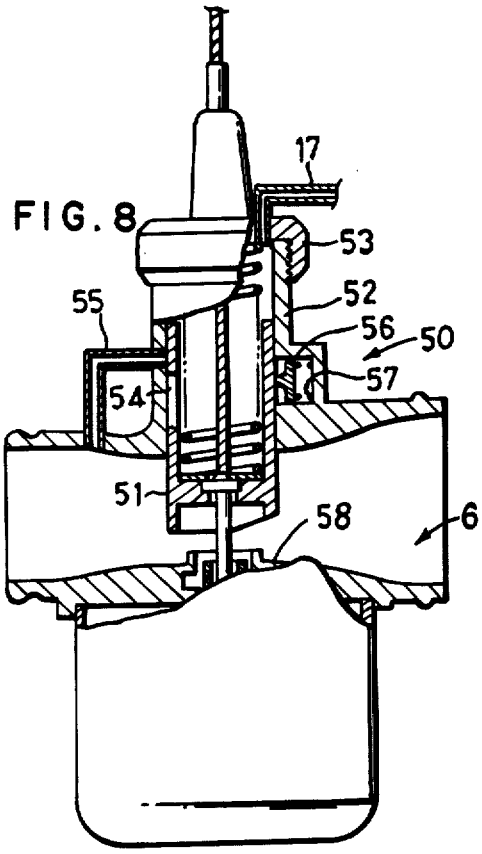
FIG. 8 is a view of the embodiment of FIG. 6 with the carburetor in partial section.

Moreover, the present invention may be modified so that the purge passage 17 is connected to a carburetor 50, as in a third embodiment shown in FIGS. 6 to 8. The construction of the carburetor 50 is shown in FIG. 8. Purge passage 17 is connected to the cap 53, which covers the guide cylinder 52 of a piston type throttle valve 51, providing communication between the inside of the guide cylinder 52 and the purge passage 17. Moreover, the throttle valve 51 has a communication hole 54 in the form of a vertical slot. Bypass passage 55 has one open end facing communication hole 5 and its other end opening into each of the intake passages 6. A push member 56, urges throttle valve by the action of a coil spring 57 into close contact with the opening of the bypass passage 55 at all times thereby to seal the communication hole 54.

In the carburetor 50 thus constructed, purge passage 17 is shut off when the engine 2 is stopped or idling because the throttle valve 51 is moved down to throttle venturi portion 58 and the communication hole 54 cannot communicate with bypass passage 55. As a result, since there is no communication between the canister 15 and the intake passages 6, none of the fuel components, adsorbed by the activated charcoal 14 flow into the intake passages 6 preventing the A/F ratio of the mixture from becoming overrich ensuring smooth running operation of the engine 2.

Needless to say, if the change-over timing of the three-way change-over valve 11 is preset to take place at the instant of complete combustion, the evaporated fuel being introduced out of the crankcase 3 directly into the air cleaner 7, is not fed before complete combustion preventing the A/F ratio from becoming overrich.

Figure 9:
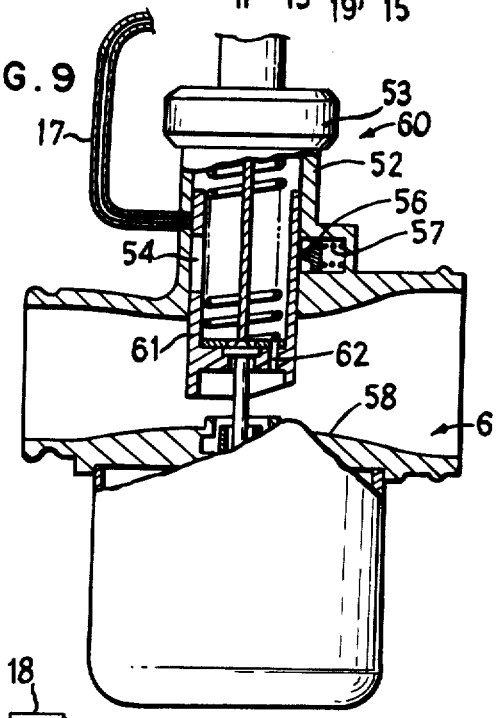
FIG. 9 is a view showing a modification to the embodiment of FIG. 6 with the carburetor in partial section.

Moreover, the aforementioned carburetor may be a modified carburetor 60 as is shown in FIG. 9. In this modification, a throttle valve 61 has a through hole 62 in the bottom wall open into the venturi portion 58, with the purge passage 17 open into the side wall of the guide cylinder 52 and facing the aforementioned communication hole 54.

Since, with this construction, purge passage 17 is in communication with the venturi portion 58 through hole 62 inside of the throttle valve 61 only when the throttle valve 61 rises during high speed running operation of the engine 2, preventing the canister 15 from being purged during idling operation, thus preventing the A/F ratio from becoming overrich.

Figure 10:
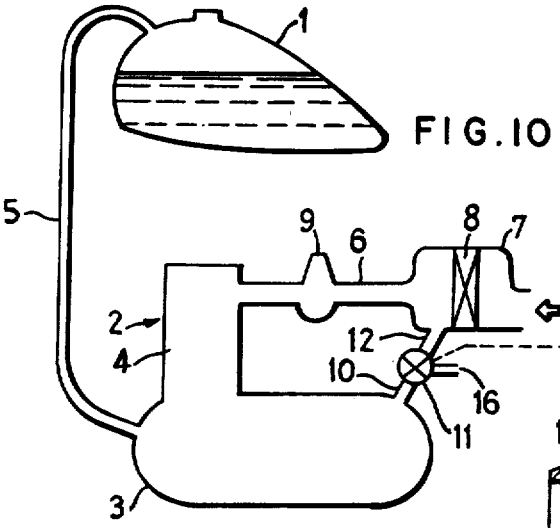
FIG. 10 is a side elevation of a fourth embodiment of the invention.
Figure 11:
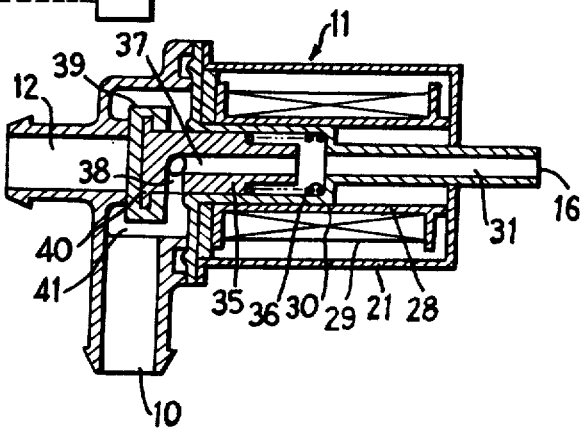
FIG. 11 is a cross-sectional view of the embodiment of FIG. 10 showing the three-way change-over valve thereof.

Although, in the aforementioned respective embodiments, the descriptions are for a construction in which the canister 15 is attached to the venting passage 13, but the canister 15 is not always indispensable, such as when the capacity of the crankcase 3 is sufficiently large, for example, so that no limitation is made to the purge passage 17. As an example of the aforementioned construction, there is a fourth embodiment shown in FIGS. 10 and 11. In this fourth embodiment, the atmospheric vent 16 is opened directly into the venting passage 13, and the three-way change-over valve 11 is constructed in the manner shown in FIG. 11. In FIGS. 10 and 11, the parts and portions having the same functions as those of the first embodiment shown in FIGS. 1 to 3 are described above and indicated by the same reference numerals.

In this fourth embodiment, when the evaporated fuel in the crankcase 3 reaches its evaporation limit while the engine 2 is stopped, it may possibly be released directly into the atmosphere through the atmospheric vent 16. However, if the capacity of the crankcase 3 is sufficiently large, the evaporated fuel doesn't exceed its evaporation limit and need not be discharged to the atmosphere. Since, moreover, the gases remaining in the crankcase 3 are breathed during the running operation of the engine, emissions to the atmosphere are far lower than with the prior art having no breathing operation. On the other hand, if the atmospheric vent 16 is in communication with a vented pipe space of a pipe frame, with the air cleaner 7 upstream of the cleaner element 8 or another vented container, for example, if the capacity of the crankcase 3 is insufficient, the insufficient capacity of the crankcase 3 can be compensated for to retain the storage.

In the respective embodiments, since their construction is so made that the introduction passage 10 leads out of the crankcase 3 so that its communication is changed between a breather passage 12 and an atmospheric vent 16 by means of the three-way change-over valve 11, an advantage is that only one change-over means simplifies the construction. However, the present invention should not be limited thereto but can be modified so that the breather passage 12 and the atmospheric vent 16 are provided independently of each other and are equipped with selectively openable control valves, respectively.

On the other hand, the number of the cylinders is not limited to three, and the present invention can be practised by other multiple cylinders or by a single cylinder.

As has been described in detail hereinbefore, according to the present invention, the crankcase for storing the fuel having been evaporated in the fuel tank is vented to the atmosphere, while the engine is stopped, and is in communication with the intake passages through the breather passage while the engine is being operated. According to the present invention, an advantage is achieved in that the evaporated fuel in the crankcase is breathed and consumed by the intake passages during the running operation of the engine so that it disappears from the crankcase without being discharged into the atmosphere whereby much evaporated fuel can be stored during the subsequent stop of the engine. Another advantage is that the evaporated fuel is not stored in the intake passages during the engine stop so that the air cleaner is not contaminated and fuel is not sucked into the engine upon engine starting preventing an overrich air-fuel ratio from occuring to ensure a smooth starting operation. Since an overrich air-fuel ratio can be prevented during engine starting operation, another advantage achieved is that the ratio of the air pollutants mixed into engine exhaust gases is minimized.

We claim:

1. An emmission prevention system for evaporated fuel in an internal combustion engine comprising; a fuel tank; overflow passage means connecting a fuel storage tank to said internal combustion engine crankcase; vent passage means for connecting said crankcase to the atmosphere; breather passage means for connecting said crankcase to the induction intake passages of said internal combustion engine; flow control means comprising a three way valve having an inlet port and two selectible outlet ports, both of said passage means incorporating said inlet port, and each being respective to one of said outlet ports, said valve being selectible to connect said crankcase to said induction intake passages through said breather passage means when said engine is operating, and to atmosphere through said vent passage means when said engine is stopped, whereby evaporated fuel overflow is stored in said crankcase and excess is vented to atmosphere when the engine is stopped and is delivered to the combustion chambers of said engine for burning when said engine is running.

2. The system according to claim 1 in which said three way valve is an electromagnetic valve operative to open said breather flow passage means to the crankcase when said engine is started and open said vent passage to atmosphere when said engine is stopped.

3. The system according to claim 1 including filtering means between said three-way valve means and an atmospheric vent.

4. The system according to claim 3 in which said filtering means comprises a canister having activated charcoal between said three-way valve means and said atmospheric vent.

5. The system according to claim 4 including a purge passage connecting said canister to said intake passage of said engine.

6. The system according to claim 5 in which said purge passage connecting said canister means to said intake passages upstream of carburetor means.

7. The system according to claim 5 in which said purge passage connecting said canister to said intake passages downstream of carburetor means.

8. The system according to claim 6 in which said purge passage connects said canister means directly to said carburetor means.

9. The system according to claim 6 in which said purge passage connects said canister means to air cleaner means.

10. The system according to claim 9 in which a second purge passage connects said air cleaner directly to combustion cylinder means of said internal combustion engine.

* * * * *